US009528794B2

(12) United States Patent
Franklin

(10) Patent No.: US 9,528,794 B2
(45) Date of Patent: Dec. 27, 2016

(54) MULTI-PURPOSE PORTABLE MAGNETIC MOUNTING DEVICE

(71) Applicant: Colton Gill Franklin, Rayville, LA (US)

(72) Inventor: Colton Gill Franklin, Rayville, LA (US)

( * ) Notice: Subject to any disclaimer, the term of this patent is extended or adjusted under 35 U.S.C. 154(b) by 14 days.

(21) Appl. No.: 14/329,626

(22) Filed: Jul. 11, 2014

(65) Prior Publication Data

US 2015/0013205 A1 Jan. 15, 2015

Related U.S. Application Data

(60) Provisional application No. 61/845,486, filed on Jul. 12, 2013.

(51) Int. Cl.

| | |
|---|---|
| ***F41A 23/18*** | (2006.01) |
| ***F41A 23/02*** | (2006.01) |
| ***F41C 27/22*** | (2006.01) |
| ***F41A 23/04*** | (2006.01) |
| ***F41A 35/00*** | (2006.01) |
| ***F41A 23/16*** | (2006.01) |
| ***F41C 33/00*** | (2006.01) |
| ***A45F 5/02*** | (2006.01) |

(52) U.S. Cl.

CPC ..... *F41C 27/22* (2013.01); *A45F 5/021* (2013.01); *F41A 23/02* (2013.01); *F41A 23/04* (2013.01); *F41A 23/16* (2013.01); *F41A 35/00* (2013.01); *F41C 33/006* (2013.01); *A45F 2200/0575* (2013.01); *A45F 2200/0591* (2013.01); *F41A 23/18* (2013.01)

(58) Field of Classification Search

CPC ..... F41A 23/18; F41A 23/02; F41A 23/04; F41A 23/16; F41A 35/00; F41C 27/22; F41C 27/00

USPC ... 248/206.5, 309.4, 683; 42/94, 99; 211/64; 224/562

See application file for complete search history.

(56) References Cited

U.S. PATENT DOCUMENTS

| | | | | |
|---|---|---|---|---|
| 5,695,165 | A * | 12/1997 | Moriarty | B01L 9/54 248/205.4 |
| 5,779,892 | A * | 7/1998 | Miltenyi | B03C 1/0332 209/223.1 |
| 7,699,277 | B2 * | 4/2010 | Bagnall | A01K 63/006 248/309.4 |
| 2004/0099776 | A1 * | 5/2004 | Dougal | A01K 97/10 248/206.5 |
| 2015/0013205 | A1 * | 1/2015 | Franklin | A45F 5/021 42/94 |
| 2015/0131269 | A1 * | 5/2015 | Franklin | F41G 1/35 362/110 |

* cited by examiner

*Primary Examiner* — Tan Le
(74) *Attorney, Agent, or Firm* — Dunlap Bennett & Ludwig PLLC

(57) ABSTRACT

A mounting device for securing and supporting at least one metallic object is provided. The mounting device may include a housing providing at least one cavity area for receiving and storing at least one first magnetic mounting element. The housing may form two opposing supporting surfaces defining a recess that coveys the magnetic forces of the at least one first magnetic mounting element there through. The supporting surfaces may provide a plurality of spaced, raised rib portions to orient and secure the at least one metallic object thereto.

24 Claims, 4 Drawing Sheets

MULTI-PURPOSE PORTABLE MAGNETIC MOUNTING DEVICE

CROSS-REFERENCE TO RELATED APPLICATION

This application claims the benefit of priority of U.S. provisional application No. 61/845,486, filed 12 Jul. 2013, the contents of which are herein incorporated by reference.

BACKGROUND OF THE INVENTION

The present invention relates to holding devices and, more particularly, to a multipurpose portable magnetic mounting device suitable for supporting a firearm or other tool incorporating ferrous metal.

In the field of hunting or other situations where unshackled access to a firearm is required, the firearms are often leaned against corners or unsafe areas while not in use, yet loaded. Existing devices for accommodating such situations are flat faced, rounded or otherwise makeshift allowing the firearm to slip to the side and/or fall off easily. Moreover, such devices are only made for mounting on a surface, and do not allow easy attachment to a belt for portable use.

Currently, there are holding devices for securing the firearm therein. However, removal of the firearm from such holding devices may be cumbersome since a portion of the firearm, say the stock, is retained within a clip, slot, receiving cavity or the like. Moreover, any additional time it takes to remove the firearm is subtracted from the time the firearm is useable in a time-sensitive hunting and/or emergency situation.

As can be seen, there is a need for a multipurpose portable magnetic mounting device suitable for supporting a firearm or other tool incorporating ferrous metal.

SUMMARY OF THE INVENTION

In one aspect of the present invention, a mounting device for securing and supporting at least one metallic object, comprises: a housing having a casing of magnetizable material forming at least one interior cavity area cooperating with two exterior opposing supporting surfaces, wherein the opposing supporting surfaces define a predetermined recess; and at least one first magnetic mounting element received and secured within the at least one cavity area.

In another aspect of the present invention, a mounting device for securing and supporting at least one metallic object, comprises: a housing having a casing of magnetizable material forming at least one interior cavity area cooperating with two exterior opposing supporting surfaces, wherein the opposing supporting surfaces define a predetermined recess, and wherein the two opposing supporting surfaces provide a plurality of spaced, raised rib portions; an elongated baseboard formed from the housing, wherein the baseboard is perpendicularly joined to the casing; at least one first magnetic mounting element received and secured within the at least one cavity area, wherein the at least one first magnetic mounting element is disposed within the at least one cavity area such that opposite polarities face each other along their respective, opposing supporting surfaces; and at least one second magnetic mounting element, wherein each second magnetic mounting element sandwiches each first magnetic mounting element to the respective supporting surface.

In another aspect of the present invention, a method of removably securing a metallic object to a foundational support, comprises: providing a mounting device comprising: a housing having a casing of magnetizable material forming at least one interior cavity area cooperating with two exterior opposing supporting surfaces, wherein the opposing supporting surfaces define a predetermined recess, and wherein the housing forms an elongated baseboard perpendicularly joined to the casing; at least one first magnetic mounting element received and secured within the at least one cavity area; and a plurality of spaced, raised rib portions along each supporting surface; mounting the mounting device to the foundational support by attaching a plurality of fasteners through the baseboard and into the foundational support; and orienting and magnetically securing the metallic object along and to the plurality of spaced, raised rib portions.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a mounting device for securing and supporting at least one metallic object. The mounting device may include a housing providing at least one cavity area for receiving and storing at least one first magnetic mounting element. The housing may form two opposing supporting surfaces defining a recess that coveys the magnetic forces of the at least one first magnetic mounting element therethrough. The supporting surfaces may provide a plurality of spaced, raised rib portions to orient and secure the at least one metallic object thereto.

Figure 1:
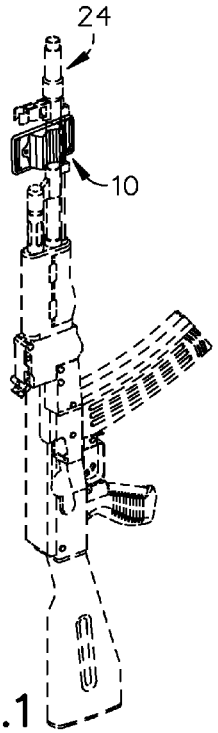
FIG. 1 is a perspective view of an exemplary embodiment of the present invention, shown in use.
Figure 2:
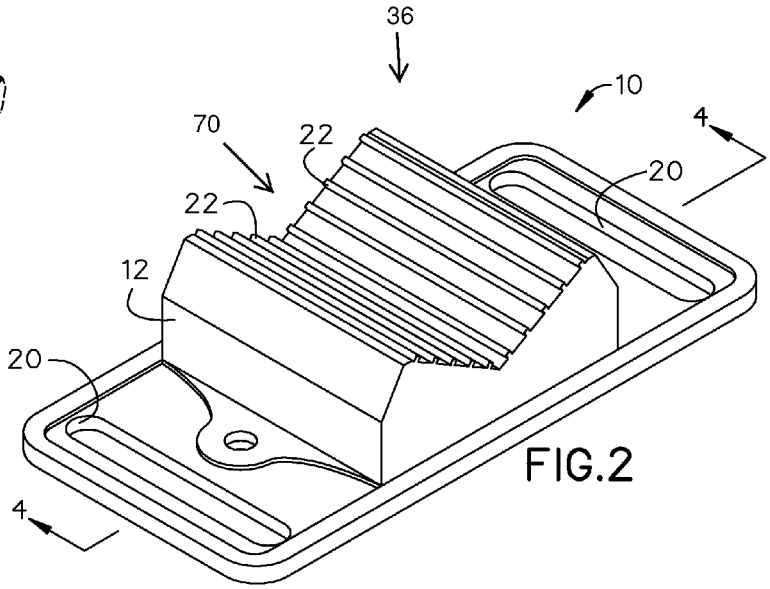
FIG. 2 is a perspective view of an exemplary embodiment of the present invention.
Figure 3:
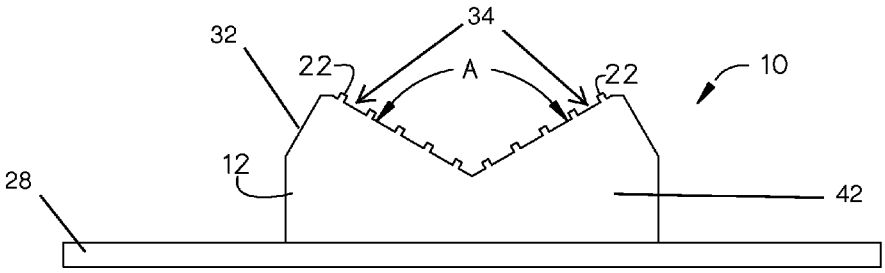
FIG. 3 is a side view of an exemplary embodiment of the present invention.
Figure 4:
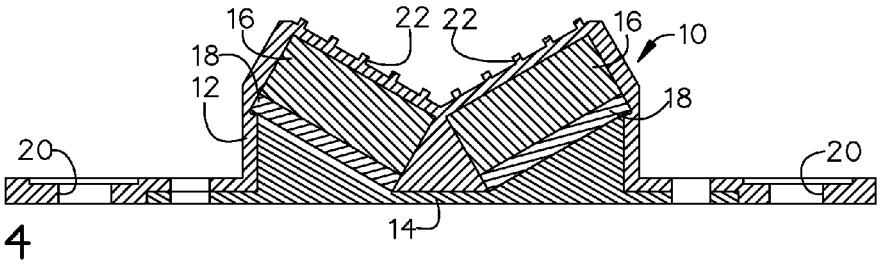
FIG. 4 is a section view of an exemplary embodiment of the present invention along line 4-4 in FIG. 2.
Figure 5:
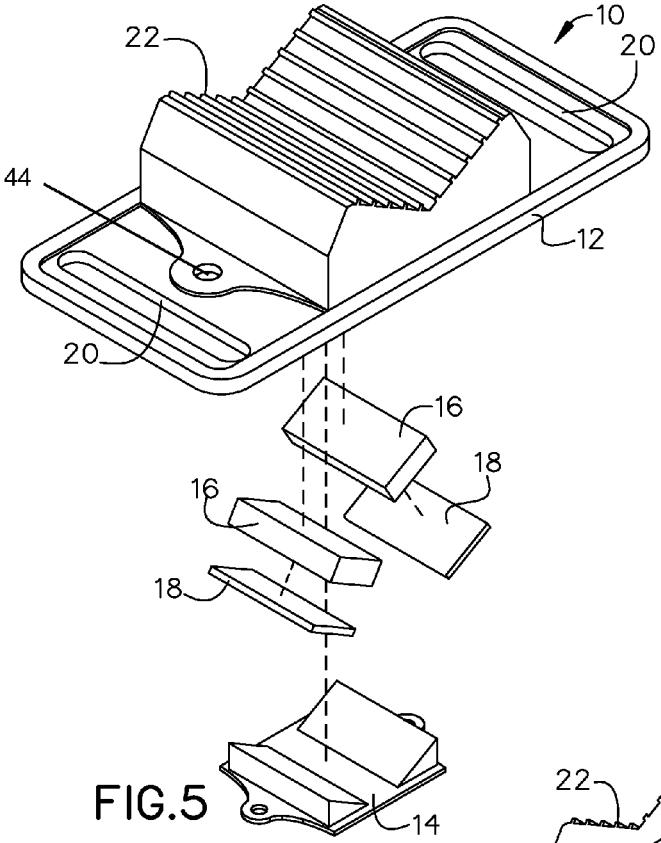
FIG. 5 is an exploded view of an exemplary embodiment of the present invention.
Figure 6:
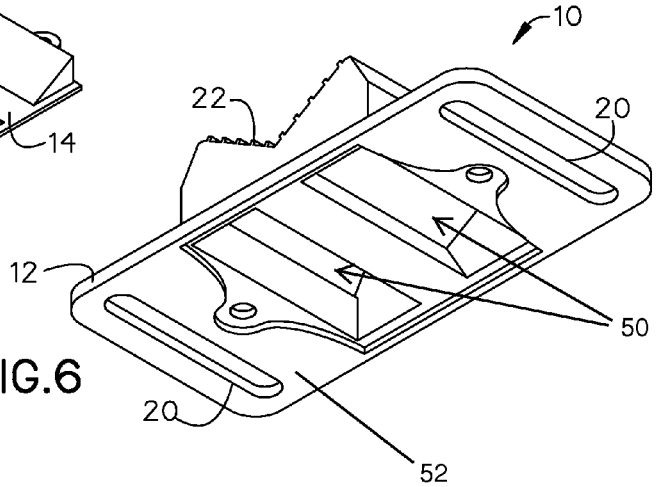
FIG. 6 is a bottom perspective view of an exemplary embodiment of the present invention.
Figure 7:
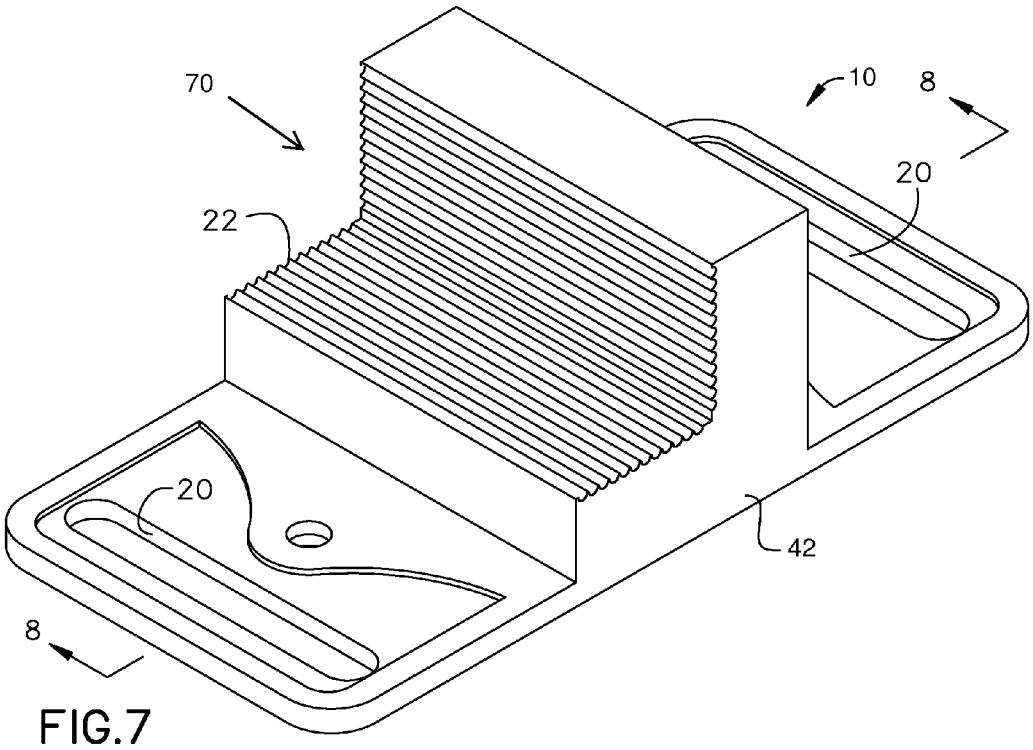
FIG. 7 is a perspective view of an exemplary embodiment of the present invention.
Figure 8:
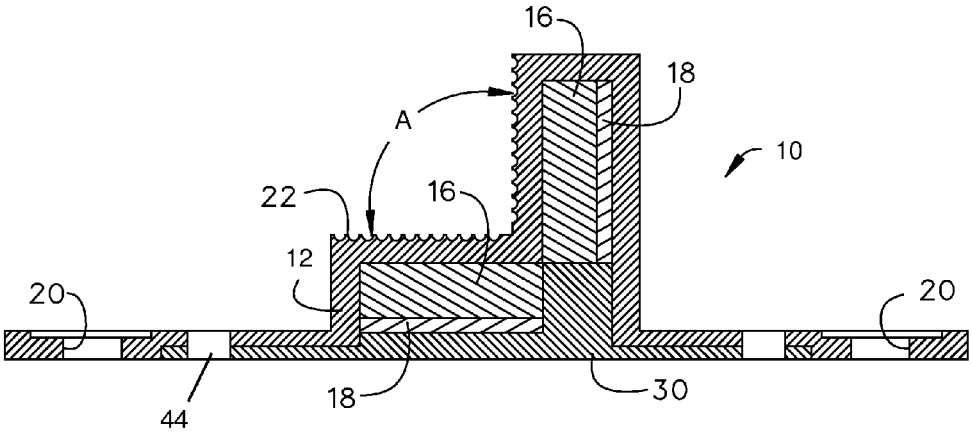
FIG. 8 is a section view of an exemplary embodiment of the present invention along line 8-8 in FIG. 7.
Figure 9:
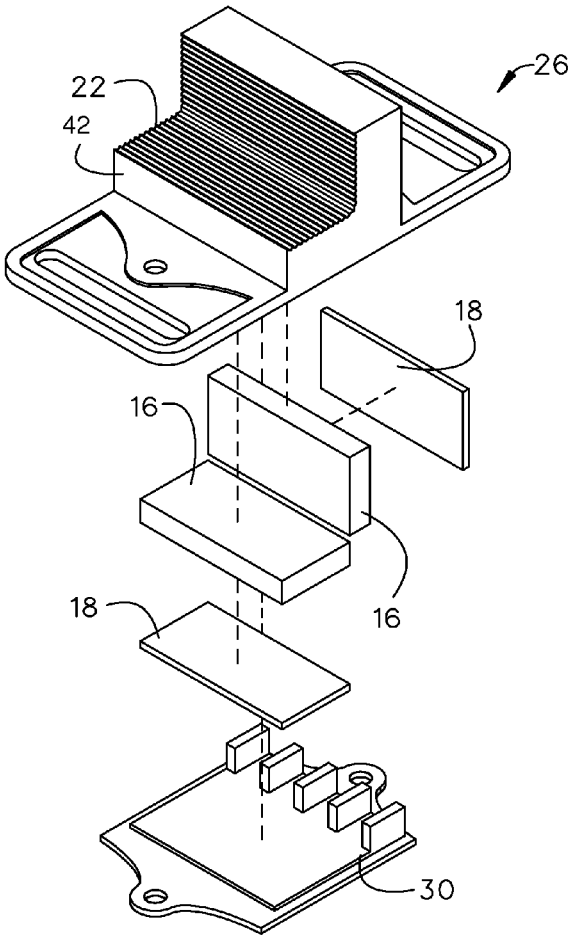
FIG. 9 is an exploded view of an exemplary embodiment of the present invention.
Figure 10:
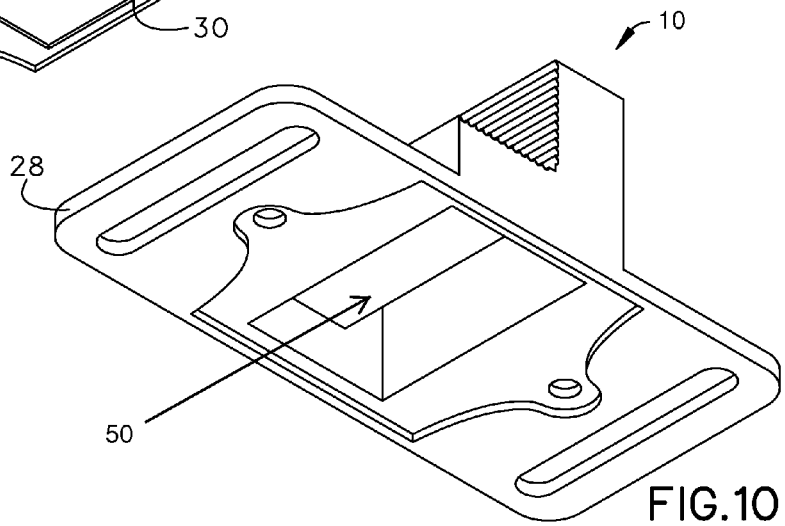
FIG. 10 is a bottom perspective view of an exemplary embodiment of the present invention.

Referring to FIGS. 1 through 10, the present invention may include a mounting device 10 for securing and supporting at least one metallic object 24. The mounting device 10 may include a housing 12 and at least one first magnetic mounting element 16. The metallic object 24 may be a firearm, a tool for hunting, a tool for construction, equipment and the like.

The housing 12 may be constructed from magnetizable material that conveys magnetic forces so as to provide a baseboard 28 and a casing 42. The baseboard 28 and the casing 42 include a supporting side 36 and a mounting side 52 having an exterior surface and an interior surface, respectively. The casing 42 may be defined by the exterior surface providing two generally opposing supporting surfaces 34 with tapered leading edges 32. The two supporting surfaces 34 may form a predetermined recess 70 by being opposed by angle A, illustrated in FIG. 3. Angle A may range from 30 degrees to 330 degrees so as to function in accordance with the present invention as described herein, though FIGS. 1 through 6 and FIGS. 7 through 10 illustrate exemplary recesses 70 having angle A at 120 degrees and 90 degrees, respectively. The tapered leading edges 32 and the two supporting surfaces 34 may be cooperatively designed so as to receive and magnetically retain the metallic object 24 to the predetermined recesses 70. The tapered leading edges 32 may prevent projecting corners from impeding the reception of the metallic object 24.

In certain embodiments, each supporting surface 34 may include a plurality of spaced, raised rib portions 22. Each rib portion 22 may be elongated and relatively narrow. The plurality of rib portions 22 may be configured to orient the at least one magnetic object 24 relative to a specified position along a portion of the corresponding supporting surface 34 and to secure said at least one magnetic object 24 in said specified position.

In alternative embodiments, the plurality of rib portions 22 may facilitate easy release of the magnetically secured metallic object 24. Likewise the plurality of rib portions 22 are spaced so as to facilitate innate, magnetically-urged spacing of adjacently placed metallic objects 24 so as to facilitate easy release of one metallic object 24 relative to an adjacent element. To serve as a stop or grips to help hold the object at certain positions or angles.

The interior surface may define at least one cavity area 50. Each cavity area 50 may be dimensioned and shaped for receiving and storing the at least one first magnetic mounting element 16 therein. Each at least one first magnetic mounting element 16 corresponding to the two supporting surfaces 34 may be disposed within their respective cavity area 50 such that opposing polarities face each other across the predetermined recess 70—i.e., the north-pole of the at least one first magnetic mounting element 16 of one supporting surface 34 faces the south-pole of the at least one first magnetic mounting element 16 of the opposing supporting surface 34. Such configuration generates attractive magnetic forces between the opposing supporting surface 34 so as to bias the at least one first magnetic mounting elements 16 toward their respective supporting surface 34. In certain embodiments, this would eliminate the need for a platform base 14, 30.

In certain embodiments, the first magnetic mounting element 16 may be a two-way magnet so that any metallic object 24 engaging the supporting surface 34 is magnetically attracted and secured thereto, and so that the mounting side 52 may be oriented, mounted and/or secured to a metallic surface.

In certain embodiments, the mounting device 10 may include at least one second magnetic mounting element 18, whereby each cavity area 50 may be dimensioned and shaped for receiving and storing the at least one second magnetic mounting element 18 therein, as illustrated in FIGS. 4 through 6 and FIGS. 8 through 10. Each second magnetic mounting element 18 may be a metallic backing plate so as to multiplicatively increase the strength of each magnetic mounting element 16 in the direction of their corresponding supporting surface 34.

The baseboard 28 may be elongated beyond the footprint of the casing 42. The baseboard 28 may be joined perpendicularly to the casing 42. The baseboard 28 may provide a plurality of bolt holes 44 through the exterior and interior surfaces of the baseboard 28. The baseboard 28 may provide a plurality of strap slots 20 through the exterior and interior surfaces of the baseboard 28 near the ends thereof. The plurality of strap slots 20 may be adapted to slidably receive straps or the like so as to removably mount the mounting device 10 to a belt or the like. The plurality of bolt holes 44 may be adapted to utilize fasteners to removably orient and mount the mounting device 10 to a foundational support made of wood, plastic, drywall and the like. It should be understood that a plurality of fasteners known in the art for fastening or removably securing one object to another including, for example, screws, bolts, snaps, Velcro-type fasteners, adhesive substances, combinations thereof, and the like, may be used to removably orient and secure the baseboard 28 and/or housing 12 to the foundational support.

In certain embodiments, the mounting device 10 may include a platform base 14, 30 adapted to secure to the mounting side 52 of the casing 42 so as to sandwich the at least one first magnetic mounting element 16 and the at least one second magnetic mounting element 18 therebetween. The platform base 14, 30 may be joined to the housing 12 through fasteners applied through the plurality of bolt holes 44. It should be understood that a plurality of fasteners known in the art for fastening or removably securing one object to another including, for example, screws, snaps, Velcro-type fasteners, adhesive substances, combinations thereof, and the like, may be used to secure the at least one first magnetic mounting element 16 and the at least one second magnetic mounting element 18 to the interior surface of the casing 42.

In certain embodiments, the platform base 14, 30 may be made of magnetizable material that conveys the magnetic force of the at least one first magnetic mounting element 16 and/or the at least one second magnetic mounting element 18 so that the platform base 14, 30 may be magnetically secured to a metallic supporting surface.

A method of using the present invention may include providing the mounting device 10 disclosed above. A user may be a hunter in a hunting blind desiring immediate, unshackled access to a firearm (magnetic object) 24 on a moment's notice that an evanescent hunting target appears. The user may removably mount the mounting device 10 to, say, a wall of the hunting blind. Then the user may rest a portion of the firearm 24 against the supporting surface 34 so that the firearm 24 is magnetically secured thereon, yet unshackled by a clip, slot, receiving cavity or the like.

In certain embodiments, the mounting device 10 may be mounted to the belt of the user by utilizing the plurality of strap slots 20.

In certain embodiments, the mounting device 10 may provide an easy access and secure way to store a flashlight and/or metallic tools of the user while they are working.

It should be understood, of course, that the foregoing relates to exemplary embodiments of the invention and that modifications may be made without departing from the spirit and scope of the invention as set forth in the following claims.

What is claimed is:

1. A mounting device for securing and supporting at least one metallic object, comprising:

a housing having a casing of magnetizable material forming at least one interior cavity area cooperating with two exterior opposing supporting surfaces, wherein the two opposing supporting surfaces define a predetermined recess, and wherein the two opposing supporting surfaces are neither substantially parallel nor planar; and at least one first magnetic mounting element received and secured within the at least one cavity area, wherein the housing forms an elongated baseboard perpendicularly joined to the casing, and wherein the elongated baseboard forms a plurality of strap slots.

2. The mounting device of claim 1, wherein the at least one first magnetic mounting element is disposed within the at least one cavity area such that opposite polarities face each other along their respective, opposing supporting surfaces.

3. The mounting device of claim 1, wherein the elongated baseboard forms a plurality of bolt holes.

4. The mounting device of claim 1, further providing a plurality of spaced, raised rib portions along each supporting surface.

5. The mounting device of claim 4, wherein the plurality of spaced, raised rib portions are elongated and narrow.

6. The mounting device of claim 1, further providing a platform base secured to the housing so as to sandwich the at least one first magnetic mounting element within the at least one cavity area.

7. The mounting device of claim 6, wherein the platform base is made of magnetizable material.

8. The mounting device of claim 2, further providing at least one second magnetic mounting element, wherein each second magnetic mounting element sandwiches each first magnetic mounting element to the respective supporting surface.

9. The mounting device of claim 1, wherein the casing provides a tapered leading edge cooperating with each supporting surface.

10. The mounting device of claim 1, wherein the predetermined recess is defined by a 90 degree angle between the two opposing supporting surfaces.

11. A mounting device for securing and supporting at least one metallic object, comprising:

a housing having a casing of magnetizable material forming at least one interior cavity area cooperating with two exterior opposing supporting surfaces, wherein the two opposing supporting surfaces define a predetermined recess, and wherein the two opposing supporting surfaces are neither substantially parallel nor planar; and at least one first magnetic mounting element received and secured within the at least one cavity area, wherein the predetermined recess is defined by a 120 degree angle between the two opposing supporting surfaces.

12. A mounting device for securing and supporting at least one metallic object, comprising:

a housing having a casing of magnetizable material forming at least one interior cavity area cooperating with two exterior opposing supporting surfaces, wherein the opposing supporting surfaces define a predetermined recess, and wherein the two opposing supporting surfaces provide a plurality of spaced, raised rib portions;

an elongated baseboard formed from the housing, wherein the baseboard is perpendicularly joined to the casing;

at least one first magnetic mounting element received and secured within the at least one cavity area, wherein the at least one first magnetic mounting element is disposed within the at least one cavity area such that opposite polarities face each other along their respective, opposing supporting surfaces; and at least one second magnetic mounting element, wherein each second magnetic mounting element sandwiches each first magnetic mounting element to the respective supporting surface.

13. The mounting device of claim 12, further providing a platform base secured to the housing so as to sandwich the at least one first and second magnetic mounting element within the at least one cavity area.

14. A method of removably securing a metallic object to a foundational support, comprising:

providing a mounting device comprising:

a housing having a casing of magnetizable material forming at least one interior cavity area cooperating with two exterior opposing supporting surfaces, wherein the opposing supporting surfaces define a predetermined recess, and wherein the housing forms an elongated baseboard perpendicularly joined to the casing;

at least one first magnetic mounting element received and secured within the at least one cavity area; and a plurality of spaced, raised rib portions along each supporting surface;

mounting the mounting device to the foundational support by attaching a plurality of fasteners through the baseboard and into the foundational support; and orienting and magnetically securing the metallic object along and to the plurality of spaced, raised rib portions.

15. The mounting device of claim 11, wherein the at least one first magnetic mounting element is disposed within the at least one cavity area such that opposite polarities face each other along their respective, opposing supporting surfaces.

16. The mounting device of claim 11, wherein the housing forms an elongated baseboard perpendicularly joined to the casing.

17. The mounting device of claim 16, wherein the elongated baseboard forms a plurality of strap slots.

18. The mounting device of claim 16, wherein the elongated baseboard forms a plurality of bolt holes.

19. The mounting device of claim 11, further providing a plurality of spaced, raised rib portions along each supporting surface.

20. The mounting device of claim 19, wherein the plurality of spaced, raised rib portions are elongated and narrow.

21. The mounting device of claim 11, further providing a platform base secured to the housing so as to sandwich the at least one first magnetic mounting element within the at least one cavity area.

22. The mounting device of claim 21, wherein the platform base is made of magnetizable material.

23. The mounting device of claim 15, further providing at least one second magnetic mounting element, wherein each second magnetic mounting element sandwiches each first magnetic mounting element to the respective supporting surface.

24. The mounting device of claim 11, wherein the casing provides a tapered leading edge cooperating with each supporting surface.

* * * * *